US007431013B2

(12) United States Patent
Hotta et al.

(10) Patent No.: US 7,431,013 B2
(45) Date of Patent: Oct. 7, 2008

(54) INTAKE AIR CONTROL DEVICE, AND VEHICLE INCLUDING SAME

(75) Inventors: Kazuhito Hotta, Saitama (JP); Tomohiro Tsutsumi, Saitama (JP); Junya Sato, Saitama (JP); Takashi Udono, Saitama (JP); Takeru Abe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 45 days.

(21) Appl. No.: 11/581,519

(22) Filed: Oct. 16, 2006

(65) Prior Publication Data

US 2007/0084440 A1 Apr. 19, 2007

(30) Foreign Application Priority Data

Oct. 18, 2005 (JP) ..... 2005-303312

(51) Int. Cl.
*F02D 9/02* (2006.01)
*F02M 35/10* (2006.01)

(52) U.S. Cl. ..... 123/399; 123/336; 180/179; 180/219

(58) Field of Classification Search ..... 123/336, 123/361, 396, 399, 352; 180/219, 179
See application file for complete search history.

(56) References Cited

U.S. PATENT DOCUMENTS

| | | | | |
|---|---|---|---|---|
| 7,121,256 | B2 * | 10/2006 | Tsukui et al. | 123/336 |
| 7,237,528 | B2 * | 7/2007 | Matsuda | 123/336 |
| 2006/0157025 | A1 * | 7/2006 | Hanasato | 123/396 |
| 2007/0169744 | A1 * | 7/2007 | Maruo et al. | 123/399 |

FOREIGN PATENT DOCUMENTS

JP 04-203431 7/1992

* cited by examiner

*Primary Examiner*—T. M Argenbright
(74) *Attorney, Agent, or Firm*—Carrier, Blackman & Associates, P.C.; William D. Blackman; Joseph P. Carrier

(57) ABSTRACT

An intake air control device is provided in which a valve shaft extends in the left and right direction of a vehicle body frame across an air intake path, and is rotatably supported by an air intake path forming body connected to an engine body, equalizing the distances from a center of the vehicle body frame in the left and right direction to both ends of the intake air control device when arranging the air intake path forming body at the center of the vehicle body frame in the left and right direction. An actuator, which applies a motive power to drive the valve shaft, is connected to one end of the valve shaft, and a throttle operating amount sensor for detecting the throttle operating amount by a vehicle operator is supported by the air intake path forming body and connected to the other end of the valve shaft.

14 Claims, 10 Drawing Sheets

INTAKE AIR CONTROL DEVICE, AND VEHICLE INCLUDING SAME

CROSS-REFERENCE TO RELATED APPLICATIONS

The present invention claims priority under 35 USC 119 based on Japanese patent application No. 2005-303312, filed on Oct. 18, 2005. The subject matter of this priority document is incorporated by reference herein.

BACKGROUND OF THE INVENTION

1. Field of the Invention

The present invention relates to an intake air control device in which a valve shaft extends across an air intake path formed in an air intake path forming body in the left and right direction of the vehicle body frame. The valve shaft is rotatably supported by the air intake path forming body, which is connected to a cylinder head of an engine body mounted to the vehicle body frame of a saddle type vehicle. A butterfly-shaped throttle valve is fixed to the valve shaft so as to control the opening of the air intake path.

2. Description of the Background Art

In a known intake air control device, an actuator, including an electric motor, is connected to an end of a valve shaft. The valve shaft is rotatably supported by an air intake path forming body for controlling the amount of intake air of an internal combustion engine to be mounted to a vehicle. Such an intake air control device is disclosed, for example, in JP-A-4-203431.

According to the intake air control device disclosed in JP-A-4-203431, a throttle operating amount sensor is provided. The throttle operating amount sensor detects the operating amount of an accelerator pedal, which corresponds to the throttle operating amount input by a vehicle operator. The throttle operating amount sensor is arranged in the vicinity of the accelerator pedal. However, when this technology is applied to a saddle type vehicle, it is desirable that the throttle operating amount sensor is unitized before being assembled to the air intake path forming body in order to facilitate assembly and reductions in size. In this case, when the air intake path forming body is connected to the engine body with the valve shaft disposed so as to be rotatably supported by the air intake path forming body in a posture of extending in the left and right direction of the vehicle body frame, even though the air intake path forming body is arranged at a center of the vehicle body frame with respect to the left and right direction, it is desirable to substantially equalize the distances from the center of the vehicle body frame with respect to the left and right direction to both ends of the intake air control device to achieve size reductions.

In view of such circumstances, it is an object of the present invention to provide an intake air control device which can be reduced in size.

SUMMARY

In order to achieve the object described above, a first aspect of the invention is directed to an intake air control device in which a valve shaft extends in the left and right direction of a vehicle body frame across an air intake path formed in an air intake path forming body. The valve shaft is rotatably supported by the air intake path forming body, which is connected to a cylinder head of an engine body. The engine body is mounted to the vehicle body frame of a saddle type vehicle, and a butterfly-shaped throttle valve is fixed to the valve shaft so as to control the opening of the air intake path. The invention is characterized in that an actuator, including an electric motor which can demonstrate a motive power to drive the valve shaft to rotate, is connected to an end of the valve shaft. In addition, a throttle operating amount sensor for detecting the throttle operating amount by a vehicle operator is supported by the air intake path forming body and connected to the other end of the valve shaft.

According to the first aspect of the invention, since the actuator, including the electric motor, is connected to one end of the valve shaft, and the throttle operating amount sensor is supported by the air intake path forming body and connected to the other end of the valve shaft, the throttle operating amount sensor can be unitized before assembling the same to the air intake path forming body. As a result, assembleability is improved and the device can be reduced in size. In addition, when the air intake path forming body is arranged at the center in the left and right direction of the vehicle body frame, the distances from the center of the vehicle body frame in the left and right direction to the both ends of the intake air control device can be substantially equalized, whereby further reductions in size are achieved.

In addition to the configuration of the invention according to the first aspect thereof, a second aspect of the invention is characterized in that the vehicle body frame includes a head pipe at the front end, and a pair of main frames bifurcated from the head pipe toward the left and right and extending toward the rear. The electric motor, having an axial line of rotation in parallel with the axial line of the valve shaft, is arranged between the both main frames as seen when viewing the saddle type vehicle from above.

According to the second aspect of the invention, the electric motor, which constitutes a part of the actuator, is protected since it is surrounded with the pair of left and right main frames.

In addition to the configuration of the invention according to the first or second aspects thereof, a third aspect of the invention is characterized in that a throttle drum, which rotates in response to the throttle operation by the vehicle operator, is mounted to the other end of the valve shaft so as to be capable of relative rotation. In addition, the throttle operating amount sensor, which is coaxial with the valve shaft, is supported by the air intake path forming body so as to oppose the throttle drum while being connected to the throttle drum.

According to the third aspect of the invention, a complex connecting structure such as a link mechanism is not necessary when connecting the throttle drum, which rotates in response to the throttle operation by the vehicle operator and the throttle operating amount sensor. Hence the throttle drum and the throttle operating amount sensor can be connected with a simple connecting structure.

In addition to the configuration of the invention according to the second or third aspects thereof, a fourth aspect of the invention is characterized in that the engine body is mounted to the vehicle body frame at a position below both of the main frames, and the actuator and the throttle operating amount sensor are arranged between both main frames and the engine body when the saddle type vehicle is viewed from the lateral side.

According to the fourth aspect of the invention, since the actuator and the throttle operating amount sensor are arranged between both main frames of the vehicle body frame and the engine body as viewed from the side, the intake air control device can be reduced in size, and since the actuator and the throttle operating amount sensor can be viewed from the side of the saddle type vehicle, the serviceability of the actuator and the throttle operating amount sensor is improved.

In addition to the configuration of the invention according to any one of the first through fourth aspects thereof, a fifth aspect of the invention is characterized in that the electric motor is arranged forwardly of the valve shaft along the fore-and-aft direction of the saddle type vehicle.

According to the fifth aspect of the invention, the electric motor can be cooled effectively by the wind generated during travel of the saddle type vehicle, and hence generation of so-called performance deterioration phenomenon, which results from heat, can be prevented so that the operability of the electric motor is increased.

In addition to the configuration of the invention according to any one of the first through fifth aspects of the invention, a sixth aspect of the invention is characterized in that the engine body has a horizontally-opposed cylinder configuration and is mounted to the vehicle body frame so that a crank axial line extends along the fore-and-aft direction of the saddle type vehicle. The axial line of the valve shaft and the axial line of rotation of the electric motor are arranged on an imaginary straight line arranged above the engine body so as to be substantially parallel with the crank axial line when viewed from a lateral side of the saddle type vehicle.

According to the sixth aspect of the invention, the intake air control device, including the actuator and the throttle operating amount sensor, can be arranged in the vicinity of the upper surface of the engine body, and hence reduction in size of the air intake system is achieved.

In addition to the configuration of the invention according to any one of the first through sixth aspects thereof, a seventh aspect of the invention is directed to a control unit which controls the movement of the electric motor so as to maintain the vehicle speed at a constant value when the automatic cruise state is selected. A cancel switch for changing the switching mode in response to application of an operational force in the closing direction to the throttle drum interlocked and connected to the valve shaft so as to follow the rotation of the valve shaft in the automatic cruising state by the vehicle operator in the automatic cruising state, and is characterized in that the control unit releases the automatic cruising state in response to the change of the switching mode of the cancel switch.

According to the seventh aspect of the invention, since the cancel switch changes the switching mode and releases the automatic cruising state when the vehicle operator operates to close the throttle in the automatic cruising state, the configuration for releasing the automatic cruising state is simplified.

An eighth aspect of the invention is directed to an intake air control device in which a valve shaft extends in the left and right direction of a vehicle body frame across an air intake path formed in an air intake path forming body. The valve shaft is rotatably supported by the air intake path forming body, which is connected to a cylinder head of an engine body. The engine body is mounted to the vehicle body frame of a saddle type vehicle, and a butterfly-shaped throttle valve is fixed to the valve shaft so as to control the opening of the air intake path. The invention is characterized in that the engine body is arranged below both main frames, and is mounted to the vehicle body frame including a head pipe at the front end and a pair of the main frames bifurcated from the head pipe to the left and right and extending toward the rear. An actuator, including an electric motor which can demonstrate a motive power to drive the valve shaft to rotate, is connected to one end of the valve shaft and arranged between the both main frames and the engine body when the saddle type vehicle is viewed from a lateral side of the vehicle.

According to the eighth aspect of the invention, the intake air control device is reduced in size by arranging the actuator between the main frames of the vehicle body frame and the engine body when viewing the saddle type vehicle from the side, and serviceability of the actuator is improved by making the actuator viewable from the side of the saddle type vehicle.

A ninth aspect of the invention is directed to an intake air control device in which a valve shaft extends in the left and right direction of a vehicle body frame across an air intake path formed in an air intake path forming body. The valve shaft is rotatably supported by the air intake path forming body, which is connected to a cylinder head of an engine body. The engine body is mounted to the vehicle body frame of a saddle type vehicle, and a butterfly-shaped throttle valve is fixed to the valve shaft so as to control the opening of the air intake path. The invention is characterized in that an actuator, including an electric motor which can demonstrate a motive power to drive the valve shaft to rotate, is connected to one end of the valve shaft. The engine body, having horizontally opposed cylinders, is mounted to the vehicle body frame so that a crank axial line extends along the fore-and-aft direction of the saddle type vehicle. In addition, an axial line of the valve shaft and an axial line of rotation of the electric motor are arranged on an imaginary straight line arranged above the engine body substantially parallel with the crank axial line when the saddle type vehicle is viewed from a lateral side thereof.

Furthermore, according to the ninth aspect of the invention, the intake air control device, including the actuator, can be arranged in the vicinity of the upper surface of the engine body and hence the air intake system can be reduced in size.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to FIGS. 1-10. It should be understood that only structures considered necessary for clarifying the present invention are described herein. Other conventional structures, and those of ancillary and auxiliary components of the system, are assumed to be known and understood by those skilled in the art. In the following description of the saddle type vehicle of the illustrative embodiment, the vehicle is exemplified by a motorcycle.

Figure 1:
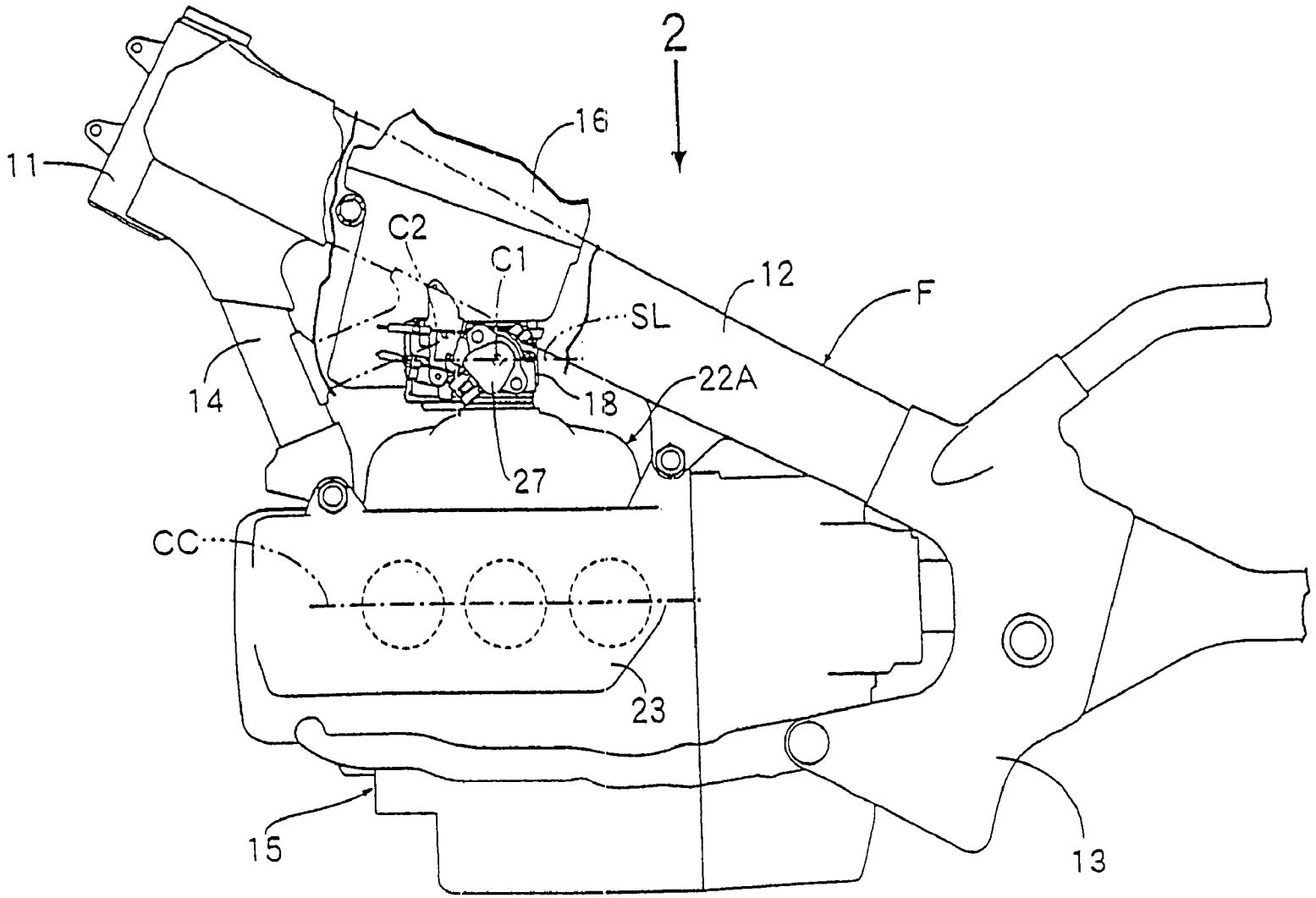
FIG. 1 is an isolated side view of a motorcycle body frame and an engine mounted thereon showing the intake air control device disposed above the engine and below the main frames.
Figure 2:
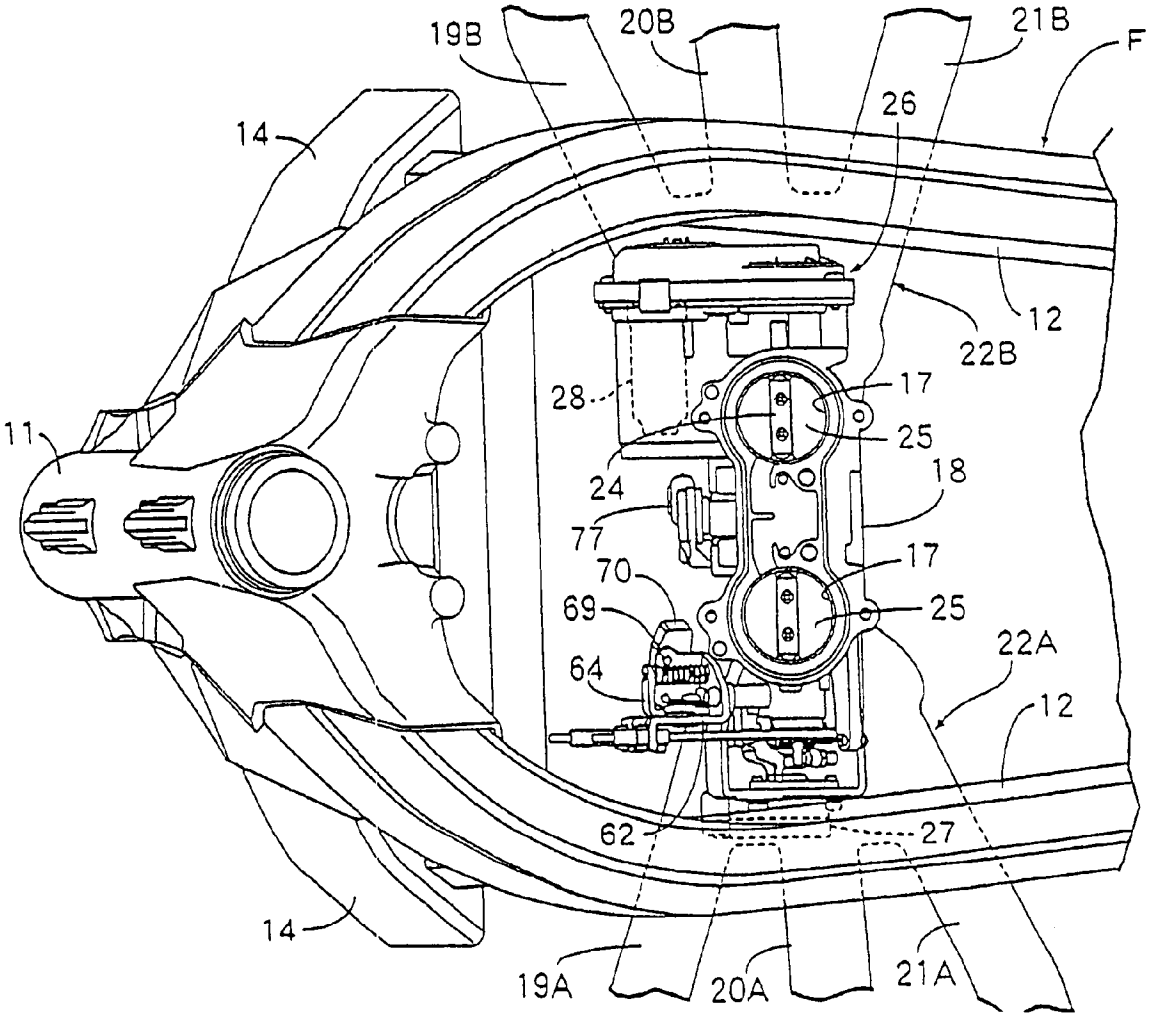
FIG. 2 is a plan view of the motorcycle body frame and the engine mounted thereon obtained by viewing in the direction indicated by an arrow 2 in FIG. 1, in a state in which an air cleaner is omitted, showing the intake air control device disposed between the left and right main frames.
Figure 3:
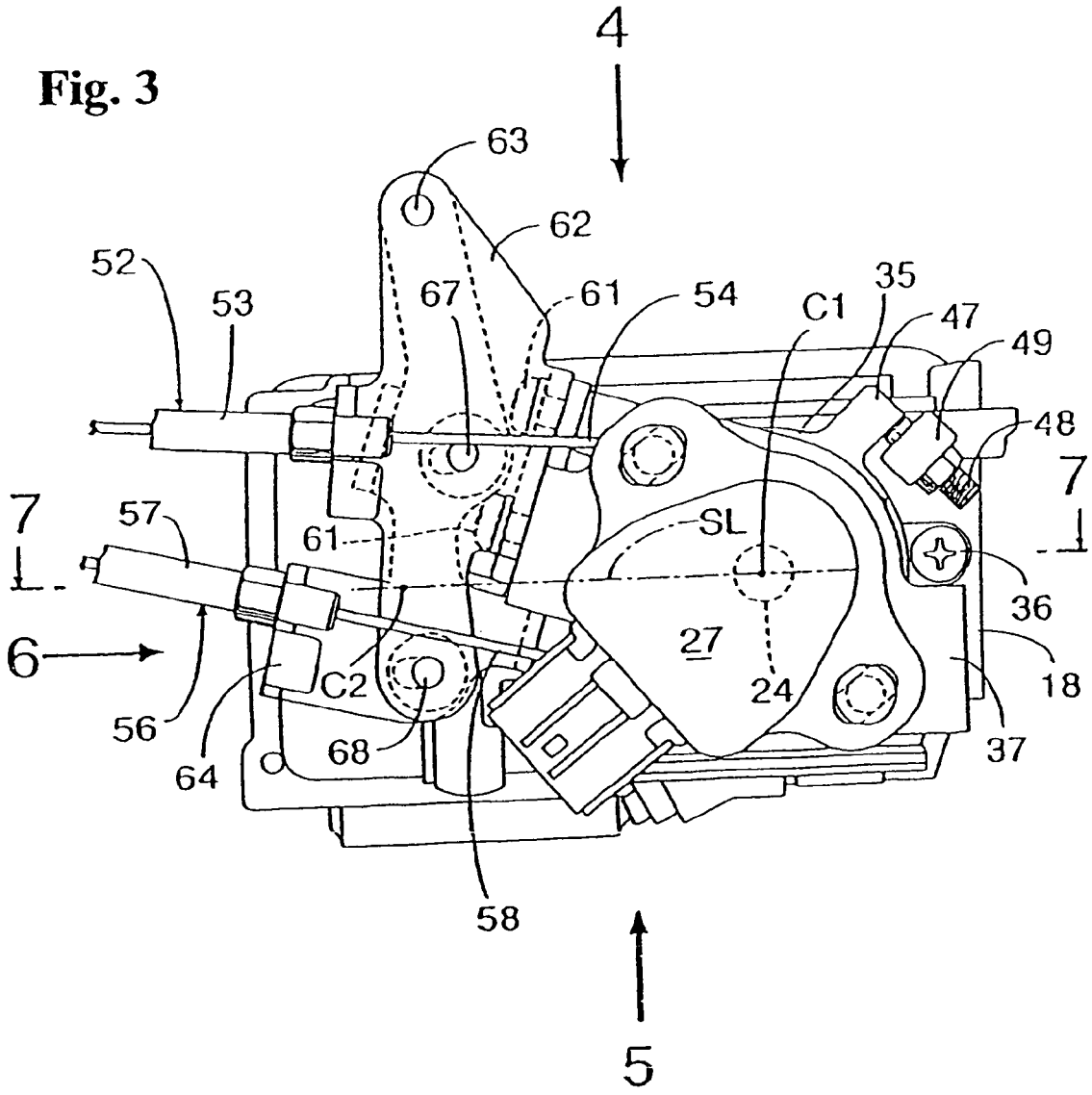
FIG. 3 is a side view of the intake air control device of FIG. 1.
Figure 4:
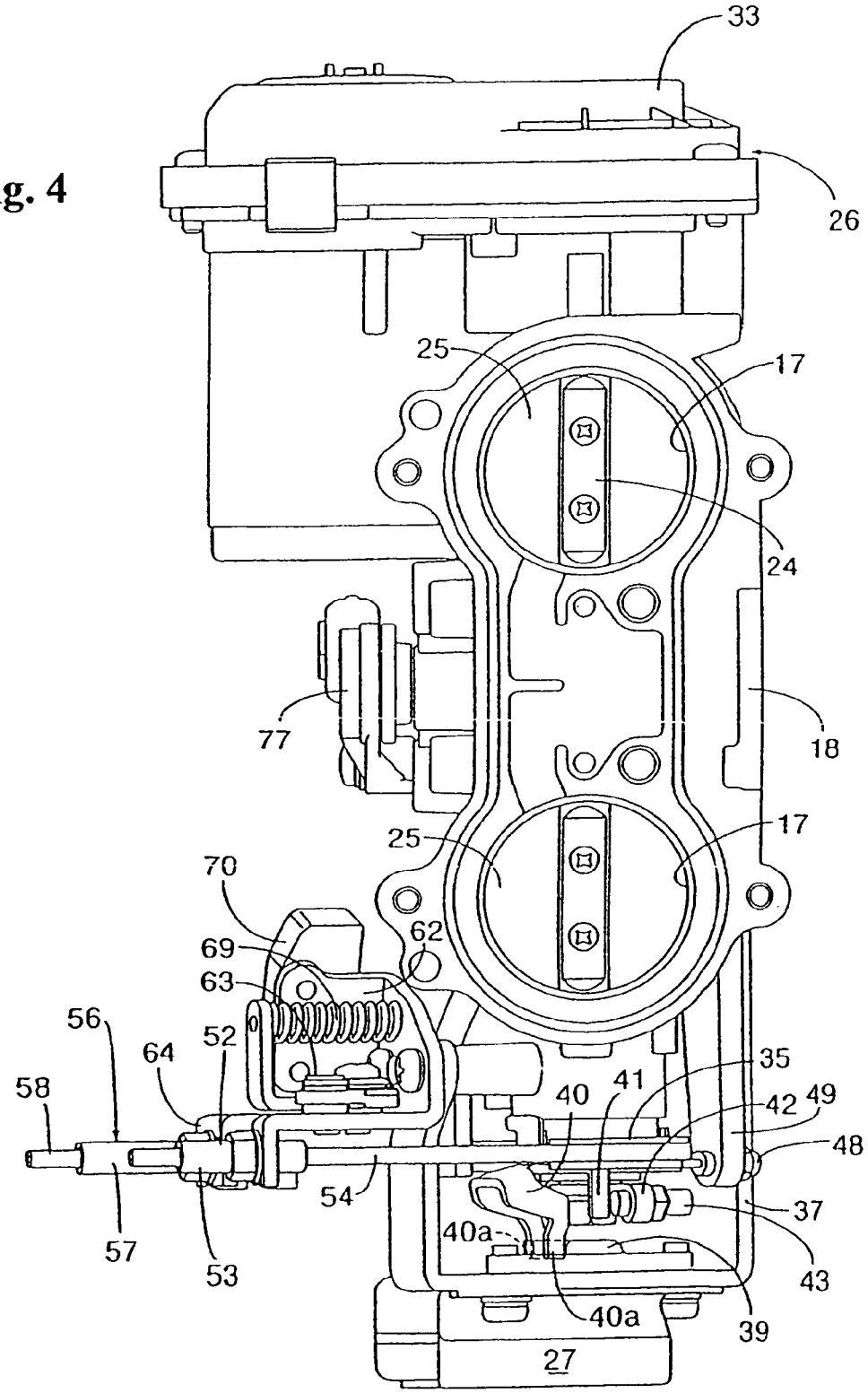
FIG. 4 is a plan view of the intake air control device of FIG. 1 obtained by viewing in the direction indicated by an arrow 4 in FIG. 3.
Figure 5:
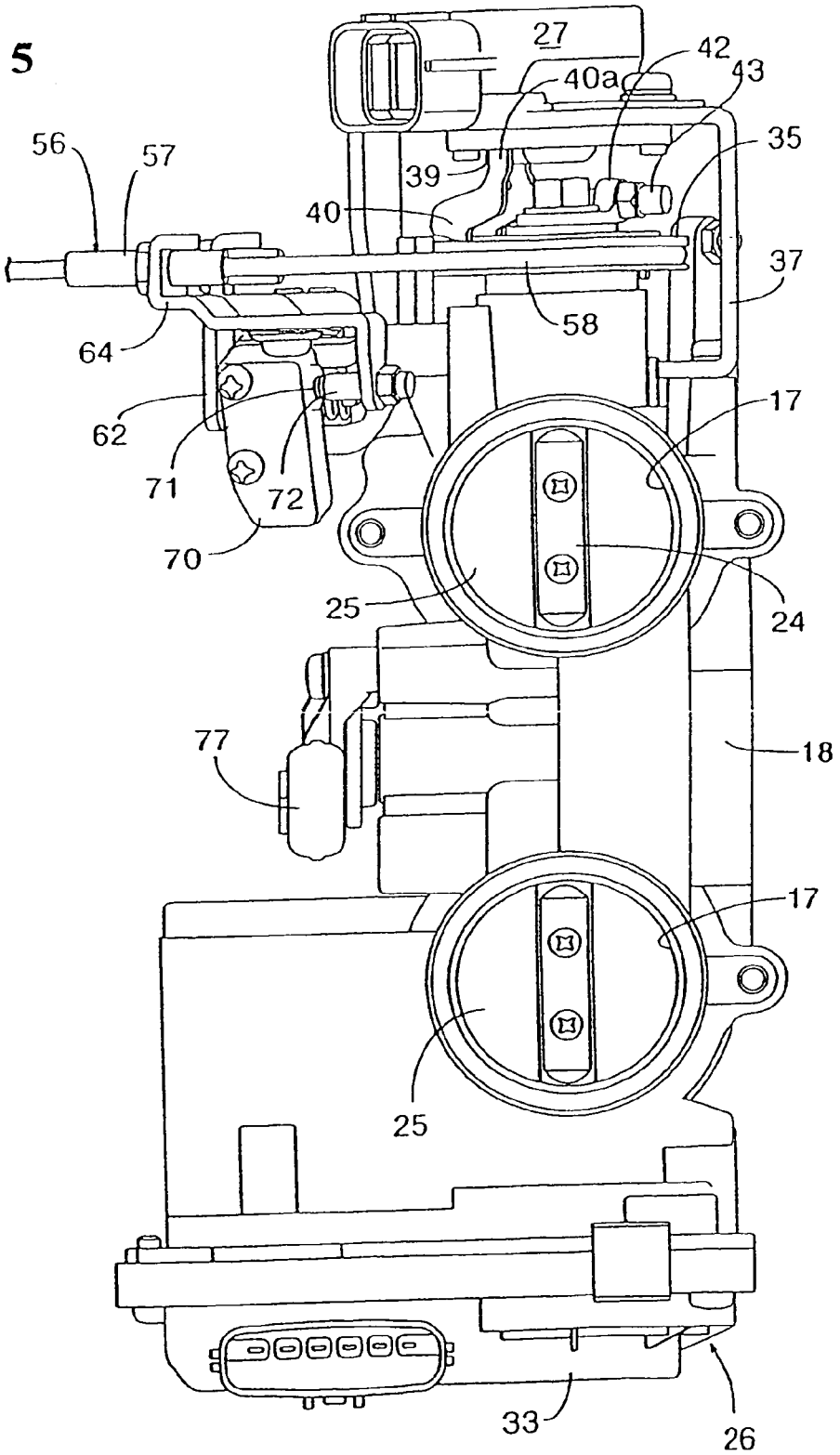
FIG. 5 is a bottom view of the intake air control device of FIG. 1 obtained by viewing in the direction indicated by an arrow 5 in FIG. 3.
Figure 6:
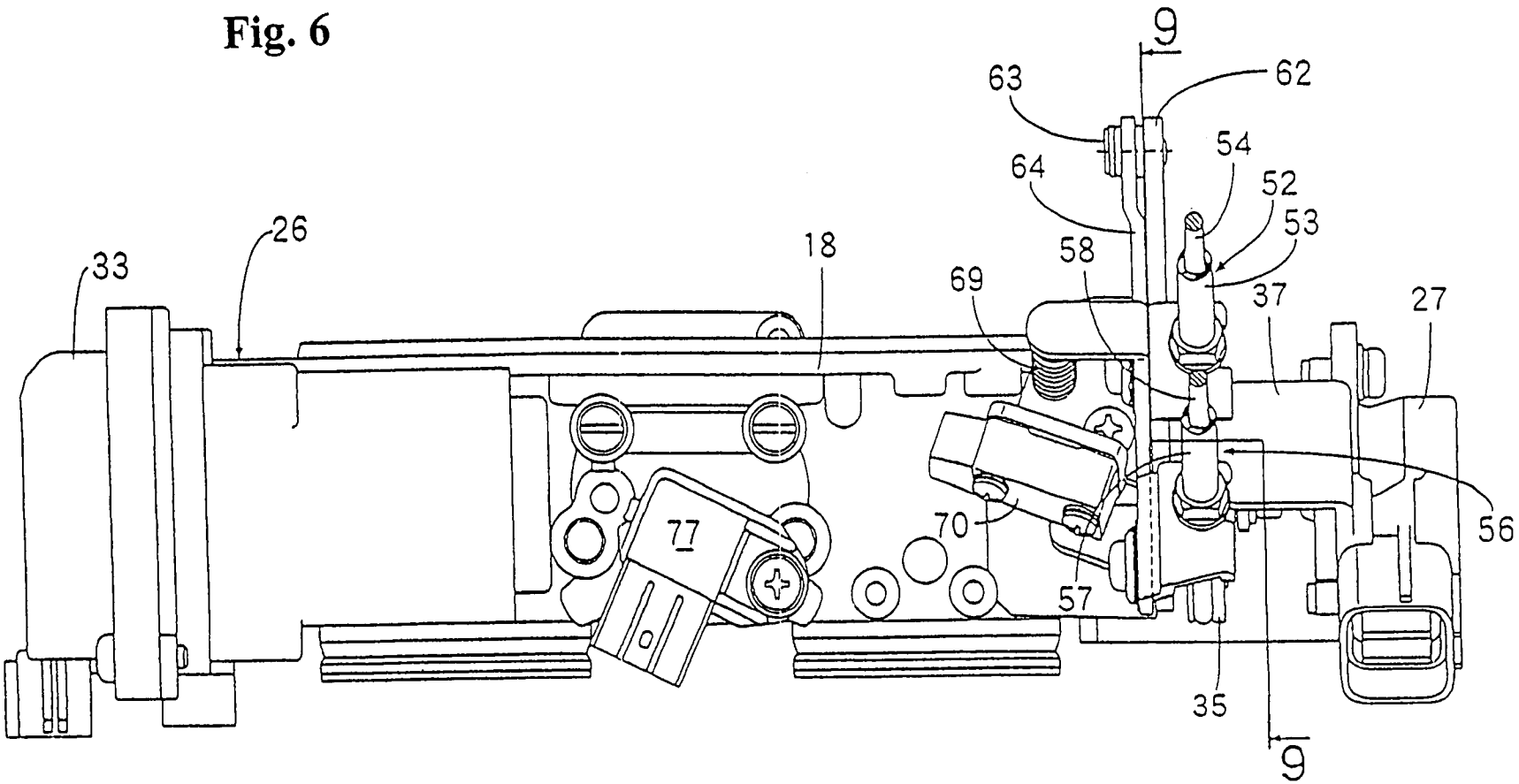
FIG. 6 is front view of the intake air control device of FIG. 1 obtained by viewing in the direction indicated by an arrow 6 in FIG. 3.

In FIG. 1 and FIG. 2, a vehicle body frame F of the motorcycle includes a head pipe 11 at a front end thereof, and a pair of left and right main frames 12 that are bifurcated from the head pipe 11 to the left and right and extend rearward while inclining downward toward the rear. The frame F also includes pivot plates 13 connected to the rear portions of the both main frames 12, and down pipes 14 bifurcated to the left and right under the both main frames 12. Down pipes 14 are connected to the head pipe 11, and extend obliquely rearward and downward at an angle steeper than the both main frames 12.

The motorcycle includes engine body 15 having six horizontally opposed cylinders including three cylinders arranged on both left and right sides so as to be aligned in the fore-and-aft direction of the motorcycle. The engine body 15 is mounted to the vehicle body frame F so as to be positioned below both main frames 12, and so that a crank axial line CC extends along the fore-and-aft direction of the motorcycle. In addition, the engine body 15 is supported by a midsection of the main frames 12, the pivot plates 13 and the down pipes 14.

An air cleaner 16 is mounted to the vehicle body frame F at a position above the engine body 15, and an air intake path forming body 18 is arranged between the air cleaner 16 and the engine body 15. The air intake path forming body 18 forms a pair of air intake paths 17, 17 arranged on the left and right direction of the vehicle body frame F. An upper portion of the air intake path forming body 18 is connected to a lower portion of the air cleaner 16 so that the upstream ends of the both air intake paths 17 communicate with the interior of a purification chamber (not shown) in the air cleaner 16. An intake manifold 22A, having three intake pipes 19A, 20A, 21A which commonly communicate with one of the downstream ends of the both air intake paths 17, and an intake manifold 22B, having three intake pipes 19B, 20B, 21B which commonly communicate with the other downstream end of the both air intake paths 17, are connected to a lower portion of the air intake path forming body 18. The respective intake pipes 19A to 21A, 19B to 21B provided by the intake manifolds 22A, 22B are connected to the left and right cylinder heads 23 provided by the engine body 15.

Referring also to FIG. 3 to FIG. 7, a valve shaft 24, extending in the left and right direction of the vehicle body frame F across the both air intake paths 17, 17, is rotatably supported by the air intake path forming body 18. Butterfly-shaped throttle valves 25, 25, for controlling the opening of the both air intake paths 17, are fixed to the valve shaft 24.

In addition, an actuator 26 provides a driving force to rotate the valve shaft 24. The actuator 26 is connected to one end (for example, a first end) of the valve shaft 24. A throttle operating amount sensor 27 detects the amount of turning operation when a rider of the motorcycle turns a throttle grip mounted to a steering handle (not shown). That is, the throttle operating amount sensor 27 detects the throttle operating amount, and is supported by the air intake path forming body 18 and connected to the other end (for example, a second end) of the valve shaft 24.

Figure 7:
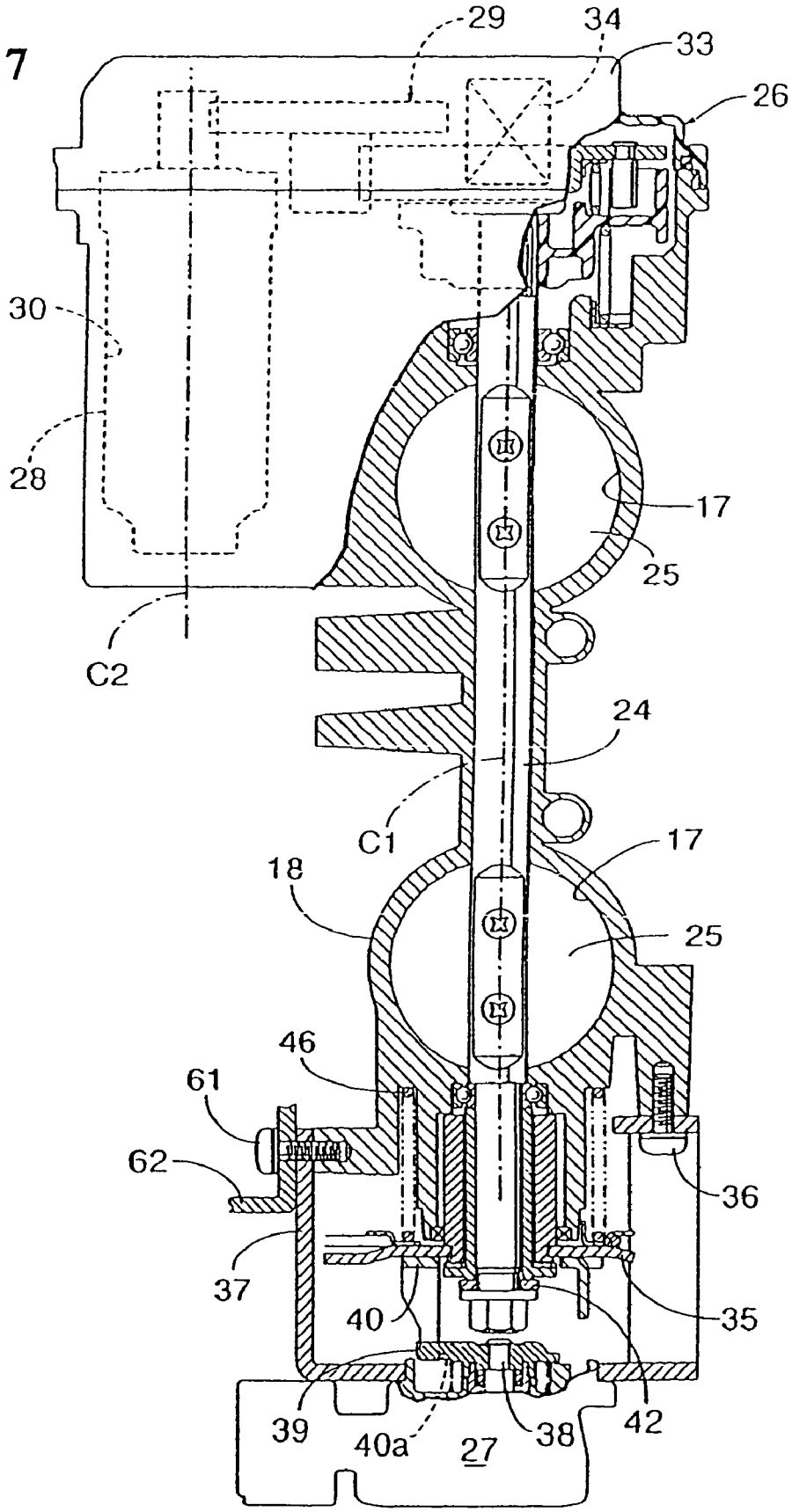
FIG. 7 is a exploded cross-sectional view of the intake air control device of FIG. 1 taken along the line 7-7 in FIG. 3.

Referring specifically to FIG. 7, the actuator 26 includes an electric motor 28 having an axial line of rotation C2 extending in parallel with the axial line of the valve shaft 24, and a decelerating gear mechanism 29 for decelerating the rotational power of the electric motor 28 and transmitting the same to the first end of the valve shaft 24. The driving motor 28 is stored and supported in a storage recess 30 provided in the air intake path forming body 18 in parallel with the axial line of the valve shaft 24. The air intake path forming body 18 is provided with a cover 33 for covering the actuator 26 mounted thereon, and covering a throttle opening sensor 34. The throttle opening sensor 34 is stored in the cover 33 so that the throttle opening sensor 34 is connected to one end (a first end) of the valve shaft 24. The throttle opening sensor 34 detects the opening of the throttle valves 25 that is, the rotational position of the valve shaft 24.

The electric motor 28 is arranged between the main frames 12 in the vehicle body frame F when the motorcycle is viewed from above (FIG. 2), and is arranged forwardly of the valve shaft 24 along the fore-and-aft direction of the motorcycle. The engine body 15 is mounted to the vehicle body frame F in a posture in which the crank axial line CC thereof extends along the fore-and-aft direction of the motorcycle. An axial line C1 of the valve shaft 24 and the axial line of rotation C2 of the electric motor 28 are arranged on an imaginary line SL (FIG. 1) arranged above the engine body 15 so as to be substantially parallel with the crank axial line CC in a side view obtained by viewing the motorcycle from the lateral side.

Figure 8:
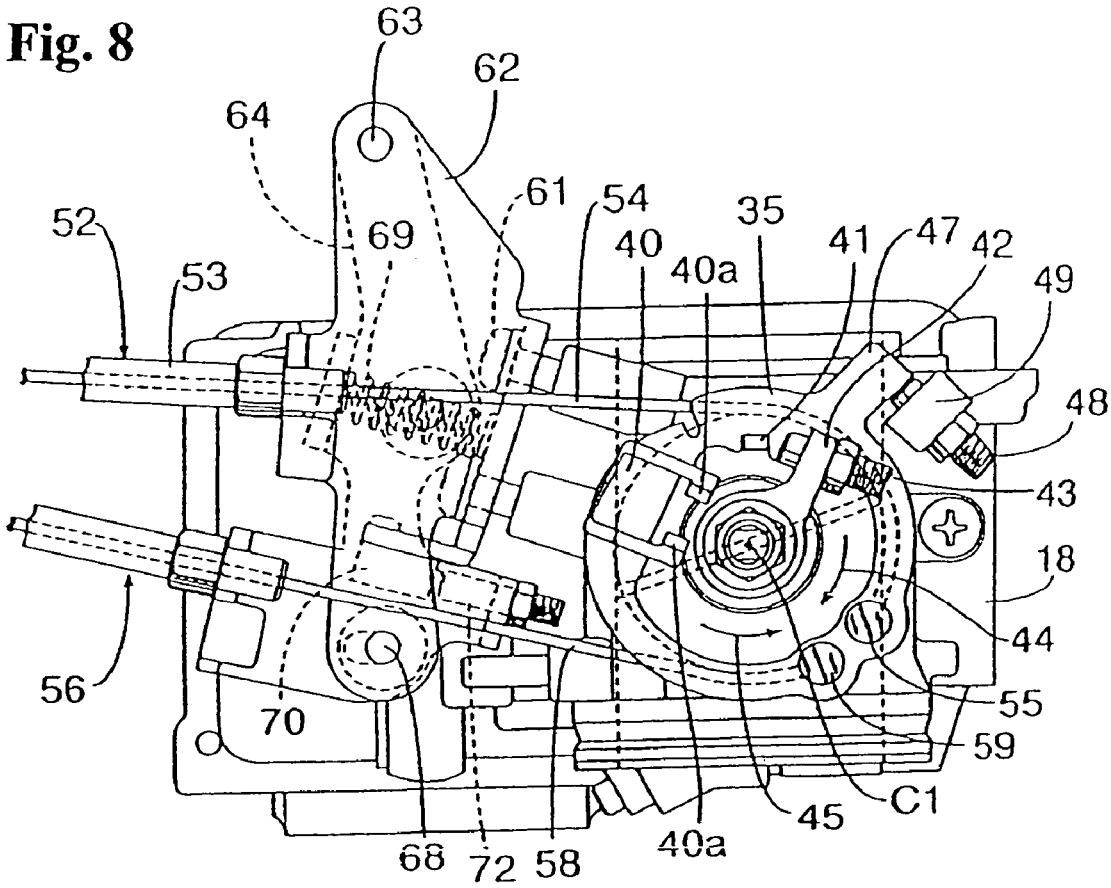
FIG. 8 is a side view of the intake air control device of FIG. 1 corresponding to FIG. 3 in a state in which a throttle operating amount sensor is omitted.

Referring also to FIG. 8, a throttle drum 35 is mounted to the second end of the valve shaft 24, that is, mounted to the end of the valve shaft 24 opposed to the actuator 26. The throttle drum 35 is mounted so as to be capable of relative rotation. The throttle operating amount sensor 27, having an axial line of rotation which is coaxial with the valve shaft 24, is mounted to a supporting frame 37. Supporting frame 37 is secured to the air intake path forming body 18 with a plurality of screw members 36 so as to cover the throttle drum 35. In this manner, the throttle operating amount sensor 27 includes a detection shaft 38 projecting toward the throttle drum 35 coaxially with the valve shaft 24, and a detection arm 39 extends radially of the detection shaft 38 and is fixed to a distal end portion of the detection shaft 38. On the other hand, an engaging arm 40 is secured to the throttle drum 35 at a position offset from the axial line C1 of the valve shaft 24, and has a pair of engaging portions 40*a*, 40*a* for sandwiching the distal end portion of the detection arm 39 from both sides along the circumference of the valve shaft 24. In other words, when the throttle drum 35 rotates about the axial line C1 of the valve shaft 24, the detection shaft 38 rotates via the engaging arm 40 and the detection arm 39, and the throttle operating amount sensor 27 detects the amount of rotation of the throttle drum 35, that is, the throttle operating amount.

In addition, the throttle operating amount sensor 27 and the actuator 26 are arranged between the main frames 12 of the vehicle body frame F and the engine body 15 as seen in a side view obtained by viewing the motorcycle from the side.

An abutment projection 41 projects from the throttle drum 35 toward the throttle operating amount sensor 27, and is provided at a position offset from the axial line C1 of the valve shaft 24. On the other hand, a proximal end portion of an abutment arm 42, which extends radially of the valve shaft 24, is fixed to the second end of the valve shaft 24 between the throttle drum 35 and the throttle operating amount sensor 27. A screw member 43, which can be brought into abutment with the abutment projection 41, is screwed into the distal end portion of the abutment arm 42 so as to permit adjustment in position of advancement. In addition, the abutment arm 42 is fixed to the valve shaft 24 so that the distal end portion of the abutment arm 42 is brought into abutment with the screw member 43 according to the relative rotation of the throttle drum 35 with respect to the valve shaft 24 in a closing direction 44 shown by an arrow in FIG. 8.

A return spring 46 (see FIG. 7) as a torsion spring is provided between the throttle drum 35 and the air intake path forming body 18, and the throttle drum 35 is rotated and urged to the closing direction by the return spring 46.

The throttle drum 35 is provided with a limiting projection 47 that projects radially outward from the outer periphery thereof. The throttle drum 35 is also provided with a limiting screw member 48 that comes into abutment with the limiting projection 47 at the end of rotation of the throttle drum 35 in the closing direction 44. The limiting screw member 48 is screwed into a supporting portion 49 provided on the air intake path forming body 18 so as to be adjustable in position of advancement. In this manner, when the throttle drum 35 is at the end of rotation in the closing direction 44 in which the limiting projection 47 is in abutment with the limiting screw member 48 and the valve shaft 24 is at the end of rotation in which the throttle valves 25 are in the closed state, a slight gap is generated between the abutment projection 41 and the screw member 43, as shown in FIG. 8.

An opening side throttle cable 52, pulled in response to the rotation of the throttle grip mounted to the steering handle (not shown) to the opening side, and a closing side throttle cable 56, pulled in response to the rotation of the throttle grip to the closing side, are connected to the throttle drum 35. The opening side throttle cable 52 and the closing side throttle cable 56 are push cables formed by inserting inner cables 54, 58 through outer cables 53, 57 so as to be capable of movement relative to the outer cables 53, 57.

The inner cable 54 pulled out from one end of the outer cable 53 of the opening side throttle cable 52 is wound around the outer periphery of the throttle drum 35 while engaging an engaging piece 55 provided at one end thereof with the throttle drum 35. The winding direction thereof is set to a direction of rotation of the throttle drum 35 in an opening direction 45 shown by an arrow in FIG. 8 at the time of pulling. The inner cable 58 drawn out from one end of the outer cable 57 of the closing side throttle cable 56 is wound around the outer periphery of the throttle drum 35 while being engaged with the throttle drum 35 at an engaging piece 59 provided at one end thereof. The winding direction thereof is set to a direction of rotation of the throttle drum 35 in the closing direction 44 at the time of pulling.

Figure 9:
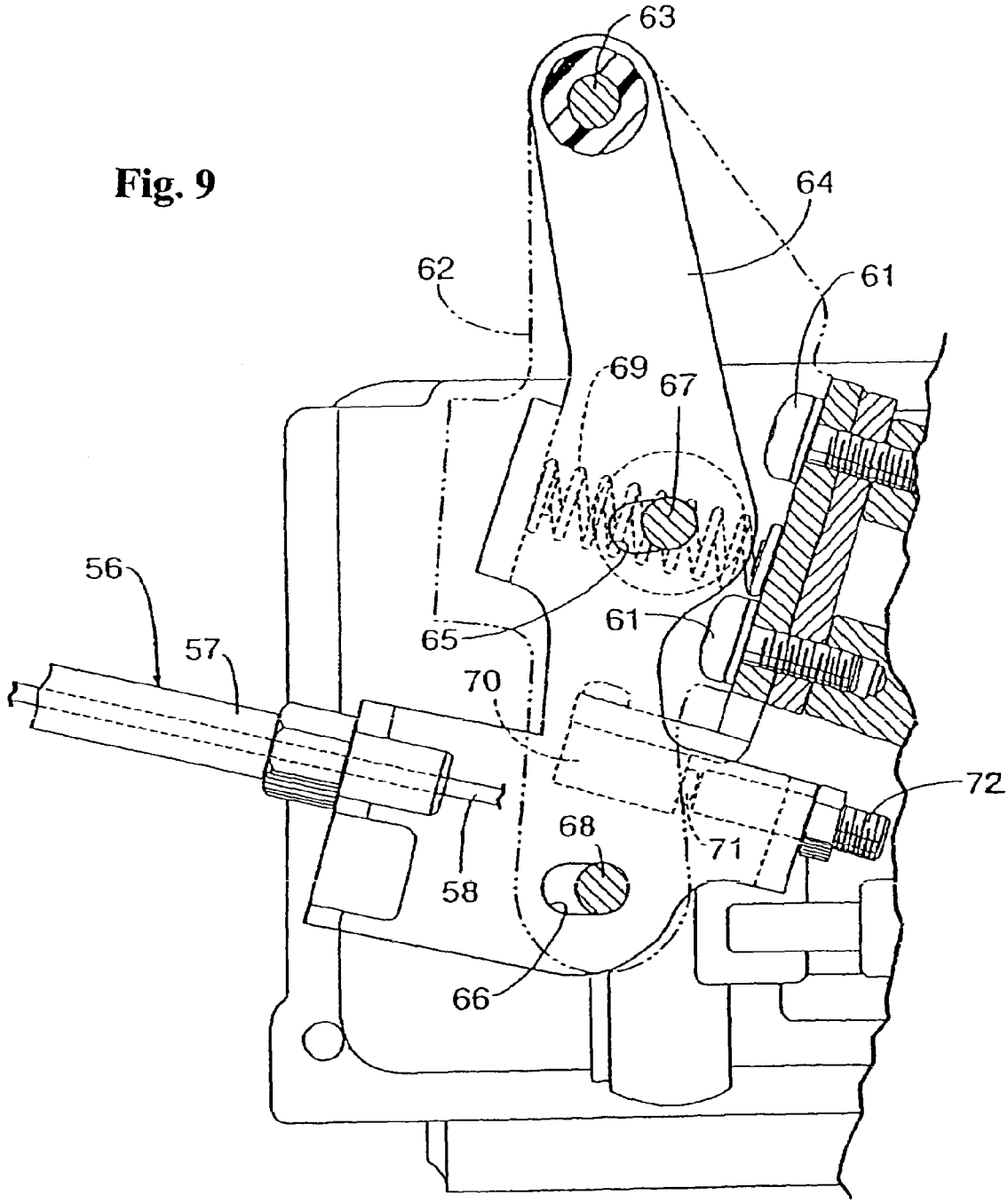
FIG. 9 is a cross-sectional view of the intake air control device of FIG. 1 taken along the line 9-9 in FIG. 6.

Referring also to FIG. 9, one end of the outer cable 53 of the opening side throttle cable 52 is supported and fixed to a fixed supporting member 62 which is secured to the supporting frame 37 with a plurality of screw members 61. On the other hand, one end of the outer cable 57 of the closing side throttle cable 56 is supported and fixed to a movable supporting member 64 rotatably supported by the fixed supporting member 62 via a spindle 63, which extends in parallel with both the throttle drum 35 and the axial line C1 of the valve shaft 24.

Arcuate-shaped elongated holes 65, 66 having a center on an axial line of the spindle 63 are provided at two positions on the movable supporting member 64. Shafts 67, 68, which are inserted respectively in these elongated holes 65, 66, are fixed to the fixed supporting member 62. Therefore, the movable supporting member 64 is rotatable about the axial line of the spindle 63 within the range in which the shafts 67, 68 can move in the elongated holes 65, 66. In addition, a coil spring 69 is provided between the fixed supporting member 62 and the movable supporting member 64 in a contracted state. A portion of the movable supporting member 64, which corresponds to the location at which one end of the outer cable 57 of the closing side throttle cable 56 is supported and fixed, is urged, via a spring load demonstrated by the spring 69, to rotate in the direction away from the throttle drum 35.

On the other hand, a cancel switch 70, which includes a detection shaft 71, is fixed to the fixed supporting member 62. A screw member 72, which can be brought into abutment with the detection shaft 71, is screwed into the movable supporting member 64 so as to be adjustable in position of advancement. In this manner, the cancel switch 70 serves to change the switching mode when the screw member 72 is moved apart from the detection shaft 71, and the screw member 72 is screwed into the movable supporting member 64 at a position that is apart from the detection shaft 71 when the movable supporting member 64 rotates against the spring force of the spring 69.

Figure 10:
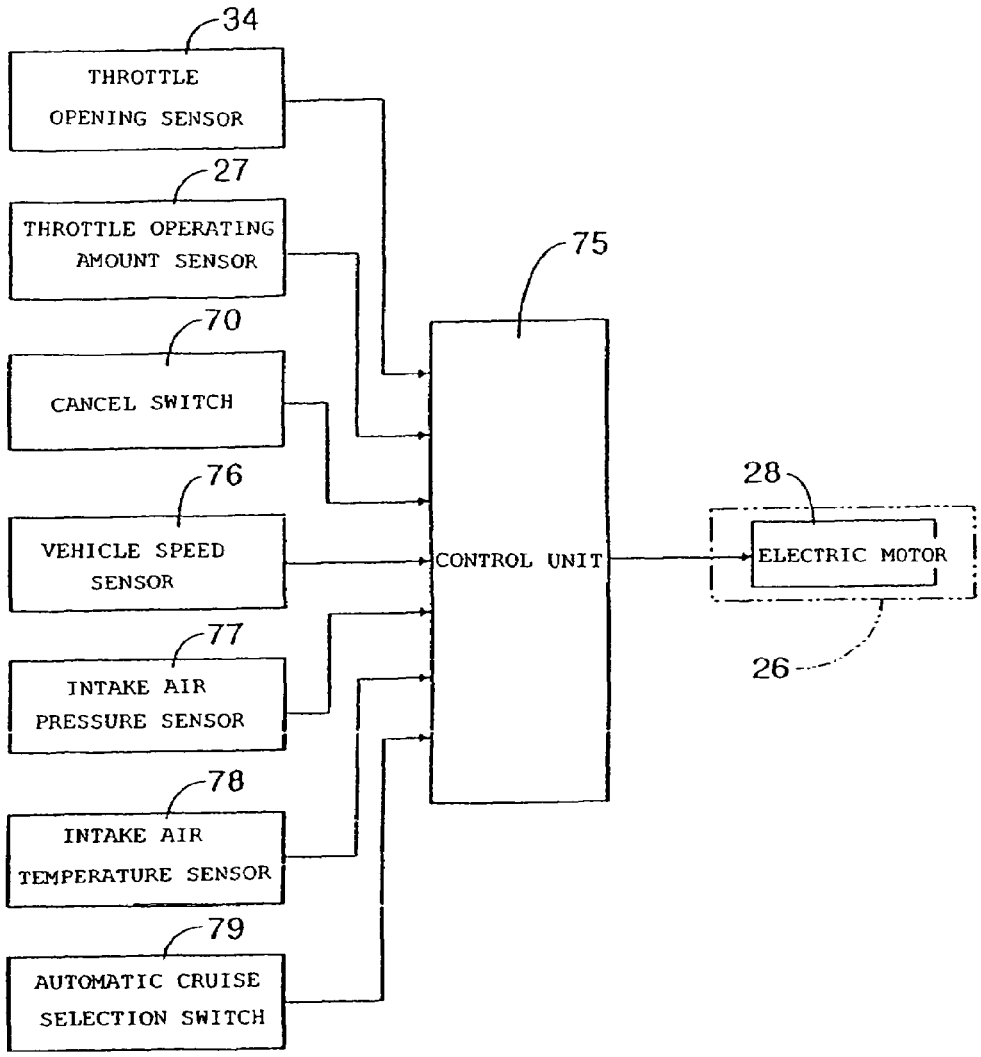
FIG. 10 is a block diagram of a throttle control system which controls the intake air control device of FIG. 1.

As shown in FIG. 10, the movement of the electric motor 28 in the actuator 26 is controlled by a control unit 75, and signals from the throttle opening sensor 34, the throttle operating amount sensor 27, the cancel switch 70, and a vehicle speed sensor 76 are supplied to the control unit 75. Signals from an intake air pressure sensor 77 mounted to a front surface of the air intake path forming body 18 for detecting the intake air pressure of the air intake path 17, an intake air temperature sensor 78 for detecting the temperature in the air cleaner 16, and an automatic cruise selection switch 79 for switching the motorcycle between the automatic cruising state and the non automatic cruising state are also supplied thereto.

In this manner, when the automatic cruise selection switch 79 selects the non automatic cruising state, in response to the supply of the amount of rotation of the throttle drum 35 in response to the turning operation of the throttle grip by the rider of the motorcycle from the throttle operating amount sensor 27, the control unit 75 controls the operation of the electric motor 28 so as to achieve the throttle opening according to the throttle operation amount.

When the automatic cruise selection switch 79 selects the automatic cruising state, the control unit 75 controls the operation of the electric motor 28 so as to control the throttle opening while considering the intake air pressure and the intake air temperature so as to maintain the vehicle speed obtained by the vehicle speed sensor 76 when the automatic cruise selection switch 79 is switched.

In such an automatic cruising state, although the rotational force of the throttle drum 35 is not supplied from the throttle grip side, the throttle drum 35 rotates while following the rotation of the valve shaft 24 via the abutment between the screw member 43 at the distal end portion of the abutment arm 42 provided on the second end of the valve shaft 24 and the abutment projection 41 of the throttle drum 35. In other words, the throttle drum 35 is interlocked and connected to the valve shaft 24 so as to follow the rotation of the valve shaft 24 in the automatic cruising state.

When the rider operates the throttle grip in the returning direction in the automatic cruising state in which the load from the valve shaft 24 side is applied to the throttle drum 35 as described above, the outer cable 57 of the returning side throttle cable 56 is applied with a load in the direction to contract the same. Then the movable supporting member 64 rotates against the spring force of the spring 69 by a reaction force thereof, the screw member 72 of the movable supporting member 64 moves apart from the detection shaft 71 of the cancel switch 70, and hence the switching mode of the cancel switch 70 is changed, whereby the control unit 75 releases the automatic cruising state in response to the change of the switching mode.

In other words, in response to the application of an operating force in the closing direction to the throttle drum 35 by the rider in the automatic cruising state, the switching mode is changed via release of the cancel switch 70, and in response thereto, the control unit 75 releases the automatic cruising state.

Now, the operation of this example will be described. The actuator 26, including the electric motor 28 which can demonstrate the motive power to drive the valve shaft to rotate, is connected to one end of the valve shaft 24 extending in the left and right direction of the vehicle body frame F and is rotatably supported by the air intake path forming body 18. The throttle operating amount sensor 27 for detecting the throttle operating amount by the rider is supported by the air intake path forming body 18 and is connected to the other end of the valve shaft 24. Thus, the throttle operating amount sensor 27 can be unitized before assembling to the air intake path forming body 18 to improve the assembleability and achieve reductions in size and, in addition, the distances from the center of the vehicle body frame F in the left and right direction to the both ends of the intake air control device can be substantially equalized in a state in which the air intake path forming body 18 is arranged at the center of the vehicle body frame F in the left and right direction.

The vehicle body frame F includes the head pipe 11 at the front end thereof and the pair of main frames 12 bifurcated from the head pipe 11 to the left and right toward the rear. In addition, the electric motor 28, having the axial line of rotation C2 extending in parallel with the axial line C1 of the valve shaft 24, is arranged between the both main frames 12 in top view obtained by viewing the motorcycle from above. Thus, the electric motor 28, which constitutes a part of the actuator 26, can be protected since it is surrounded with the pair of left and right main frames 12.

With the electric motor 28 arranged forwardly of the valve shaft 24 along the fore-and-aft direction of the motorcycle, the electric motor 28 is cooled effectively by wind generated by travel of the motorcycle, and generation of performance deterioration phenomenon resulted from heat is prevented so that the operability of the electric motor 28 is increased.

The throttle drum 35, which rotates in response to the throttle operation by the rider, is mounted to the other end of the valve shaft 24 so as to be capable of relative rotation. The throttle operating amount sensor 27, which is coaxial with the valve shaft 24, is supported by the air intake path forming body 18 so as to oppose the throttle drum 35 while being connected to the throttle drum 35. Thus, a complex connecting structure such as a link mechanism is not necessary when connecting the throttle drum 35 and the throttle operating amount sensor 27, and hence the throttle drum 35 and the throttle operating amount sensor 27 are connected with a simple connecting structure.

In addition, since the engine body 15 is mounted to the vehicle body frame F at a position downwardly of the both main frames 12, and the actuator 26 and the throttle operating amount sensor 27 are arranged between the both main frames 12 and the engine body 15 in side view obtained by viewing the motorcycle from the side, the intake air control device can be reduced in size. In addition, the actuator 26 and the throttle operating amount sensor 27 can be viewed between the main frames 12 and the engine body 15 when viewing the motorcycle from the side, whereby the serviceability of the actuator 26 and the throttle operating amount sensor 27 is improved.

The engine body 15, configured as a horizontal opposed type, is mounted to the vehicle body frame F in a posture with the crank axial line CC extending along the fore-and-aft direction of the motorcycle. The axial line C1 of the valve shaft 24 and the axial line of rotation C2 of the electric motor 28 are arranged on the imaginary line SL arranged above the engine body 15 in substantially parallel to the crank axial line CC in side view obtained by viewing the motorcycle from the side. Therefore, the intake air control device is arranged in the vicinity of the upper surface of the engine body 15, and hence the air intake system is reduced in size.

In addition, the throttle drum 35 is interlocked and connected to the valve shaft 24 so as to follow the rotation of the valve shaft 24 in the automatic cruising state. Therefore, when the rider applies the operating force in the closing direction to the throttle drum 35 while in the automatic cruising state, the switching mode is changed via the cancel switch 70 and, in response thereto, the control unit 75 releases the automatic cruising state, whereby the structure to release the automatic cruising state is simplified.

Although the example of the present invention has been described thus far, the invention is not limited to the embodiment described above, and various modifications in design can be performed without departing from the invention stated in Claims.

For example, the electric motor 28 can be arranged rearwardly of the valve shaft 24 along the fore-and-aft direction of the motorcycle, and if doing so, the capacity of the air cleaner 16 arranged on the upper front of the air intake path forming body 18 can be increased. The present invention can be implemented widely not only in motorcycles, but also in saddle type vehicles generally.

What is claimed is:

1. An intake air control device for controlling the air intake of an engine mounted to a vehicle body frame of a saddle-type vehicle, the engine comprising a cylinder head and an air intake path forming body connected to the cylinder head, the intake air control device comprising:

a valve shaft extending in the left and right direction of the vehicle body frame across an air intake path formed in the air intake path forming body, the valve shaft rotatably supported by the air intake path forming body, a butterfly-shaped throttle valve fixed to the valve shaft so as to control the opening of the air intake path, an actuator, the actuator comprising an electric motor which can demonstrate a motive power to drive the valve shaft to rotate, a throttle drum which rotates in response to a throttle operation by the vehicle operator, and a throttle operating amount sensor which detects the throttle operating amount by a vehicle operator, the throttle operating amount sensor being supported by the air intake path forming body, wherein the actuator is connected to one end of the valve shaft, and a throttle operating amount sensor is connected to an other end of the valve shaft, and wherein the throttle drum is mounted to the other end of the valve shaft so as to be capable of relative rotation, and wherein the throttle operating amount sensor, which is coaxial with the valve shaft, is supported by the air intake path forming body so as to oppose the throttle drum while being connected to the throttle drum.

2. The intake air control device according to claim 1, wherein the vehicle body frame comprises a head pipe at a front end of the vehicle body frame, and a pair of main frames which are bifurcated from the head pipe toward the left and right and extending toward the rear, and wherein the electric motor comprises an axial line of rotation in parallel with an axial line of the valve shaft, and is arranged between the main frames as seen when the vehicle is viewed from above.

3. The intake air control device according to claim 2, wherein the engine body is mounted to the vehicle body frame at a position below the main frames, and wherein the actuator and the throttle operating amount sensor are arranged between the main frames and the engine body when viewed from a lateral side of the vehicle.

4. The intake air control device according to claim 1, wherein the electric motor is arranged within the intake air control device at a location forward of the valve shaft along the fore-and-aft direction of the vehicle.

5. The intake air control device according to claim 1, wherein the engine comprises a horizontally opposed cylinder configuration and is mounted to the vehicle body frame in an orientation in which a crank axial line extends along the fore-and-aft direction of the vehicle, and the axial line of the valve shaft and the axial line of rotation of the electric motor are arranged on an imaginary straight line arranged above the engine body in substantially parallel with the crank axial line when viewed from a lateral side of the vehicle.

6. The intake air control device according to claim 1, wherein the throttle drum is configured to be interlocked and connected to the valve shaft so as to follow the rotation of the valve shaft when the vehicle is in an automatic cruising state, and the intake air control device further comprises a control unit which controls the movement of the electric motor so as to maintain a vehicle speed at a constant value when an automatic cruise state is selected, and a cancel switch for changing a switching mode in response to application of an operational force in the closing direction to the throttle drum by the vehicle operator when the vehicle is in an automatic cruising state, wherein the control unit releases the automatic cruising state in response to the change of the switching mode of the cancel switch.

7. An intake air control device which controls the air intake of an engine mounted to a vehicle body frame of a saddle-type vehicle, the engine comprising a cylinder head and an air intake path forming body connected to the cylinder head, the intake air control device comprising:

a valve shaft extending in the left and right direction of the vehicle body frame across an air intake path formed in the air intake path forming body, the valve shaft rotatably supported by the air intake path forming body, a butterfly-shaped throttle valve fixed to the valve shaft so as to control the opening of the air intake path, and an actuator connected to one end of the valve shaft, the actuator comprising an electric motor which can demonstrate a motive power to drive the valve shaft to rotate, the vehicle body frame comprising:

a head pipe at a front end of the vehicle body frame, and a pair of main frames which are bifurcated from the head pipe toward the left and right and extending toward the rear, wherein the engine body is mounted to the vehicle body frame below the main frames, and the actuator is arranged between the main frames and the engine body when viewed from a lateral side of the vehicle.

8. An intake air control device which controls the air intake of an engine mounted to a vehicle body frame of a saddle-type vehicle, the engine comprising a cylinder head and an air intake path forming body connected to the cylinder head, the intake air control device comprising:

a valve shaft extending in the left and right direction of the vehicle body frame across an air intake path formed in the air intake path forming body, the valve shaft rotatably supported by the air intake path forming body, a butterfly-shaped throttle valve fixed to the valve shaft so as to control the opening of the air intake path, and an actuator connected to one end of the valve shaft, the actuator comprising an electric motor which can demonstrate a motive power to drive the valve shaft to rotate, wherein the engine comprises a horizontally opposed cylinder configuration and is mounted to the vehicle body frame in an orientation in which a crank axial line extends along the fore-and-aft direction of the vehicle, and the axial line of the valve shaft and the axial line of rotation of the electric motor are arranged on an imaginary straight line arranged above the engine body in substantially parallel with the crank axial line when viewed from a lateral side of the vehicle.

9. A saddle type vehicle employing an intake air control device, the vehicle comprising:

a vehicle body frame, an engine mounted to the vehicle body frame, the engine comprising a cylinder head and an air intake path forming body connected to the cylinder head, and an intake air control device which controls the air intake of the engine, the intake air control device comprising:

a valve shaft extending in the left and right direction of the vehicle body frame across an air intake path formed in the air intake path forming body, the valve shaft rotatably supported by the air intake path forming body, a butterfly-shaped throttle valve fixed to the valve shaft so as to control the opening of the air intake path, an actuator, the actuator comprising an electric motor which can demonstrate a motive power to drive the valve shaft to rotate, a throttle drum which rotates in response to a throttle operation by the vehicle operator and a throttle operating amount sensor which detects the throttle operating amount by a vehicle operator, the throttle operating amount sensor being supported by the air intake path forming body, wherein the actuator is connected to one end of the valve shaft, and a throttle operating amount sensor is connected to an other end of the valve shaft, wherein the throttle drum is mounted to the other end of the valve shaft so as to be capable of relative rotation, and wherein the throttle operating amount sensor, which is coaxial with the valve shaft, is supported by the air intake path forming body so as to oppose the throttle drum while being connected to the throttle drum.

10. The saddle type vehicle according to claim 9, wherein the vehicle body frame comprises a head pipe at a front end of the vehicle body frame, and a pair of main frames which are bifurcated from the head pipe toward the left and right and extending toward the rear, and wherein the electric motor comprises an axial line of rotation in parallel with an axial line of the valve shaft, and is arranged between the main frames as seen when the vehicle is viewed from above.

11. The saddle type vehicle according to claim 10, wherein the engine body is mounted to the vehicle body frame at a position below the main frames, and wherein the actuator and the throttle operating amount sensor are arranged between the main frames and the engine body when viewed from a lateral side of the vehicle.

12. The saddle type vehicle according to claim 9, wherein the electric motor is arranged within the intake air control device at a location forward of the valve shaft along the fore-and-aft direction of the vehicle.

13. The saddle type vehicle according to claim 9, wherein the engine comprises a horizontally opposed cylinder configuration and is mounted to the vehicle body frame in an orientation in which a crank axial line extends along the fore-and-aft direction of the vehicle, and the axial line of the valve shaft and the axial line of rotation of the electric motor are arranged on an imaginary straight line arranged above the engine body in substantially parallel with the crank axial line when viewed from a lateral side of the vehicle.

14. The saddle type vehicle according to claim 10, wherein the throttle drum is configured to be interlocked and connected to the valve shaft so as to follow the rotation of the valve shaft when the vehicle is in an automatic cruising state, and the intake air control device further comprises:

a control unit which controls the movement of the electric motor so as to maintain a vehicle speed at a constant value when an automatic cruise state is selected, and a cancel switch for changing a switching mode in response to application of an operational force in the closing direction to the throttle drum by the vehicle operator when the vehicle is in an automatic cruising state, wherein the control unit releases the automatic cruising state in response to the change of the switching mode of the cancel switch.

* * * * *